US008590703B2

(12) United States Patent
Tierney et al.

(10) Patent No.: US 8,590,703 B2
(45) Date of Patent: Nov. 26, 2013

(54) CASE FOR HEADPHONES

(75) Inventors: Julie Tierney, Shrewsbury, MA (US); Nathan D. Schaal, Cambridge, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/417,369

(22) Filed: Mar. 12, 2012

(65) Prior Publication Data

US 2013/0233745 A1 Sep. 12, 2013

(51) Int. Cl.
*B65D 85/00* (2006.01)

(52) U.S. Cl.
USPC ..... 206/320; 206/736; 150/154

(58) Field of Classification Search
USPC ..... 206/320, 736, 769, 770, 304.1, 304.2, 206/314; 150/154, 901; 53/441
See application file for complete search history.

(56) References Cited

U.S. PATENT DOCUMENTS

| | | | | | |
|---|---|---|---|---|---|
| 1,265,046 | A | | 5/1918 | Burnham | |
| 4,232,808 | A | * | 11/1980 | Gray | 224/610 |
| 4,424,899 | A | | 1/1984 | Rosenberg | |
| D281,033 | S | * | 10/1985 | Mohri | D3/295 |
| 4,865,191 | A | * | 9/1989 | Easter | 206/316.3 |
| 5,094,344 | A | | 3/1992 | Savage | |
| 5,101,974 | A | * | 4/1992 | Alwitt | 206/316.2 |
| 5,706,353 | A | * | 1/1998 | Arai et al. | 381/77 |
| 5,775,530 | A | | 7/1998 | Attaway | |
| 5,887,720 | A | * | 3/1999 | Lin | 206/702 |
| 6,006,915 | A | * | 12/1999 | Moor | 206/579 |
| 6,021,983 | A | * | 2/2000 | Congdon | 248/187.1 |
| 6,170,663 | B1 | * | 1/2001 | Glassman | 206/461 |
| 6,305,538 | B1 | * | 10/2001 | Jackson | 206/316.3 |
| 6,914,995 | B2 | * | 7/2005 | Kao | 381/370 |
| 7,051,895 | B2 | * | 5/2006 | Toussant et al. | 220/287 |
| D580,167 | S | | 11/2008 | Jones | |
| D588,356 | S | | 3/2009 | Lown et al. | |
| D592,400 | S | | 5/2009 | Nelson | |
| D594,659 | S | | 6/2009 | Lown et al. | |
| D598,650 | S | | 8/2009 | Lown et al. | |
| D599,546 | S | | 9/2009 | Lown et al. | |
| D604,501 | S | * | 11/2009 | Lee | D3/201 |
| D609,009 | S | | 2/2010 | Schaal et al. | |
| 7,854,373 | B2 | * | 12/2010 | Chen | 229/162.2 |
| 2002/0166858 | A1 | * | 11/2002 | Ogishima et al. | 220/359.4 |
| 2005/0279661 | A1 | * | 12/2005 | Hodges | 206/320 |
| 2006/0001307 | A1 | * | 1/2006 | Embach | 297/391 |
| 2007/0256946 | A1 | | 11/2007 | Godshaw et al. | |
| 2009/0194444 | A1 | | 8/2009 | Jones | |
| 2009/0194550 | A1 | | 8/2009 | Yount | |
| 2010/0078343 | A1 | * | 4/2010 | Hoellwarth et al. | 206/320 |
| 2010/0122755 | A1 | | 5/2010 | Post | |
| 2010/0181222 | A1 | * | 7/2010 | Aiko et al. | 206/461 |
| 2011/0146858 | A1 | * | 6/2011 | Parks | 150/154 |
| 2012/0325701 | A1 | * | 12/2012 | Debitzky | 206/320 |

* cited by examiner

*Primary Examiner* — Steven A. Reynolds
(74) *Attorney, Agent, or Firm* — Brian M. Dingman; Dingman IP Law, PC

(57) ABSTRACT

A case for headphones that have two earpads connected by a flexible headband, where the earpads have a compressible portion that is adapted to sit on the ear or head. The case includes a tray that defines an open front that is adapted to receive the headphones. The tray defines structure that maintains the headband in tension. There is a resiliently stretchable cover fixed to the tray and defining a free portion adapted to be moved from a closed position wherein the cover closes the open front of the tray to an open position wherein the open front of the tray is at least substantially exposed.

10 Claims, 8 Drawing Sheets

CASE FOR HEADPHONES

FIELD

This disclosure relates to a case that holds headphones.

BACKGROUND

Audio headphones are sometimes sold with a case in which the headphones can be stored. Cases that are designed to hold and protect the headphones during transport are typically hard plastic clamshell-style cases. These cases are bulky and thus relatively difficult to transport. Also, since the headphones cannot be seen when they are in the case, the case can detract from the ability to attractively display the headphones in retail packaging.

SUMMARY

In general, one aspect of the disclosure features a case for headphones that have two earpads connected by a flexible headband, where the earpads have a compressible portion that is adapted to sit on the ear or head. The case for headphones comprises a tray defining an open front that is adapted to receive the headphones; the tray comprises structure that maintains the headband in tension. There is a resiliently stretchable cover fixed to the tray and defining a free portion adapted to be moved from a closed position wherein the cover closes the open front of the tray to an open position wherein the open front of the tray is at least substantially exposed.

Various additional implementations may include one or more of the following features. In the open position the cover and the tray may together define a pocket that receives the headband such that a downward force is present on the headband. The tray may define a wider end where the earpads are located and a narrower end where a portion of the headband is located, and the pocket may be located at the narrower end of the tray. The free portion of the cover may define an outside and an inside. In the closed position the outside of the free portion of the cover may overly and face outward from the front of the tray, and in the open position the inside of the free portion of the cover may face outward from the pocket.

Still other implementations may include one or more of the following features. The tray may further define structure that supports the headphones such that the compressible portions of the earpads are not substantially compressed. The structure that supports the headphones such that the compressible portions of the earpads are not substantially compressed may comprise posts projecting upwardly from the tray, wherein the earpads sit on the posts. The posts may be located in the earpads. The headphones may be received by the tray such that the earpads do not touch each other. The headphone case may further comprise a strap fixed to the tray and that defines a first position in which it lies across and restrains the headband and a second position in which it is free from and does not restrain the headband.

Further implementations may include one or more of the following features. The structure that maintains the headband in tension may comprise projections against which the headband sits. The projections may be defined proximate two opposed edges of the tray. The projections may be defined by walls of a raised plateau that spans most of the width of the tray. The plateau may be spaced from the edge of the tray. The projections may be about at least as high as the width of the headband at the locations where the headband sits against the projections. The projections may be substantially the same height as the width of the headband at the locations where the headband sits against the projections. The tray may further define shelves adjacent to the projections, where the headband rests on the shelves.

In general, another aspect of the disclosure features a case for headphones that comprise two earpads connected by a flexible headband, wherein the earpads have a compressible portion that is adapted to sit on the ear or head. The case comprises a tray defining an open front that is adapted to receive the headphones such that the earpads do not touch each other, wherein the tray defines a plateau spaced from the edges of the tray and that defines a raised wall that spans most of the width of the tray, that is substantially the same height as the width of the headband and that defines sidewalls against which the headband sits so as to maintain the headband in tension. The tray further comprises upwardly-projecting posts located in the earpads and that support the earpads such that their compressible portions are spaced above the tray surface. There is a resiliently stretchable cover fixed to the tray and defining a free portion adapted to be moved from a closed position wherein the cover closes the open front of the tray to an open position wherein the open front of the tray is at least substantially exposed. In the open position the cover and the tray together define a pocket that receives the headband such that a downward force is present on the headband. The tray defines a wider end where the earpads are located and a narrower end where a portion of the headband is located, and wherein the pocket is located at the narrower end of the tray. The free portion of the cover defines an outside and an inside. In the closed position the outside of the free portion of the cover overlies and faces outward from the front of the tray, and in the open position the inside of the free portion of the cover faces outward from the pocket.

In general, yet another aspect of the disclosure features a case for headphones that comprise two earpads connected by a flexible headband, wherein the earpads have a compressible portion that is adapted to sit on the ear or head. The case comprises a tray defining an open front that is adapted to receive the headphones such that the earpads do not touch, wherein the tray defines projections against which the headband sits so as to maintain the headband in tension, and further defines shelves adjacent to the projections. The headband rests on the shelves to maintain the headphones such that the compressible portions of the earpads are spaced above the tray surface. There is a resiliently stretchable cover fixed to the tray and defining a free portion adapted to be moved from a closed position wherein the cover closes the open front of the tray to an open position wherein the open front of the tray is at least substantially exposed. In the open position the cover and the tray together define a pocket that receives the headband such that a downward force is present on the headband. The tray defines a wider end where the earpads are located and a narrower end where a portion of the headband is located, and the pocket is located at the narrower end of the tray. The free portion of the cover defines an outside and an inside. In the closed position the outside of the free portion of the cover overlies and faces outward from the front of the tray. In the open position the inside of the free portion of the cover faces outward from the pocket.

DETAILED DESCRIPTION OF THE DRAWINGS

A case for headphones that securely holds headphones, is thinner than a clamshell case, and can be used to appropriately display the headphones for retail sale can have an open-front rigid tray that is adapted to receive the headphones in a manner in which the headband is maintained in tension. A resiliently stretchable cover is fixed to the tray, and in one orientation completely covers the open front of the tray to secure the headphones in the tray. The cover can be folded back and reversed inside out and engaged with a part of the lip of the tray to define an open position in which the headphones are visible for retail sale and accessible to the user, yet still securely held in the tray.

Figure 1:
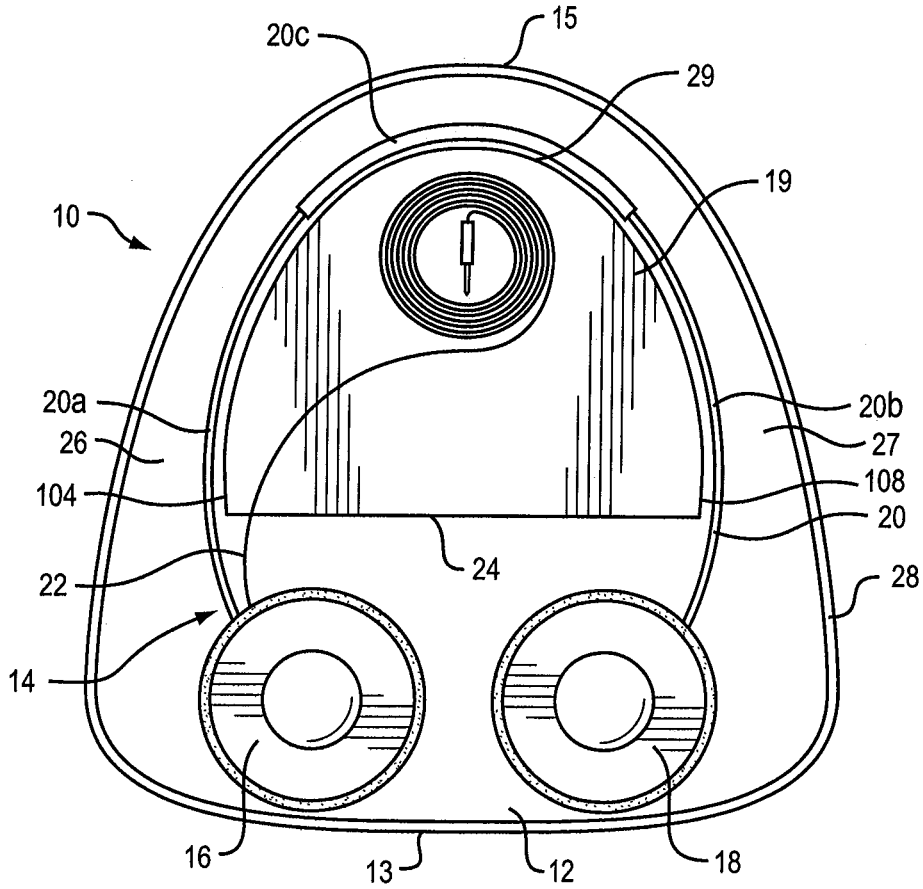
FIG. 1 is a top view of a case for headphones.

FIG. 1 depicts case 10 for headphones. Audio headphones 14 include earpads 16 and 18 that are carried at the ends of flexible headband 20, and audio signal input cord 22. Case 10 includes open-front tray 12 that defines a wide end 13 proximate the earpads and a narrower end 15 proximate the distal portion 20*c* of headband 20. Tray 12 also defines exterior edge or lip 28. Tray 12 is sufficiently rigid to provide the structural function of the case as described herein and accomplish appropriate crush resistance. The tray can be constructed in different manners and of different materials. In one embodiment, tray 12 is made from ethylene vinyl acetate (EVA) which can readily be molded to the desired thickness and shape.

Tray 12 includes structure that maintains the headband in tension. In this non-limiting example, the structure is accomplished by the walls that define the edges of "D"-shaped raised plateau 19, including wall 24 that defines one edge of raised plateau 19 and spans most of the central width of the tray, but stops short of tray rim 28 to define channels 26 and 27 that are sized and shaped to receive headband 20. End walls 104 and 108 of ledge 24 are spaced sufficiently far apart to accommodate a headband nestled against distal wall 29 of raised plateau 19. Headphones 14 are placed into tray 12 such that distal end 20*c* of headband 20 lies against or proximate distal end wall 29 of raised plateau 19. In an unconstrained relaxed state, the opposed portions of headband 20 that will lie against walls 104 and 108 (i.e., portions 20*a* and 20*b*, respectively) are a defined distance apart. Plateau 19 is constructed and arranged to define walls 104 and 108 that are spaced apart more than this distance. The result is that headband 20 is flexed outwardly when it is placed over plateau 19 and thus is held in tension by plateau 19. This helps to maintain headband 20 in place in the tray.

Headphone earpads typically include a soft, compressible portion that is adapted to lie against the ears or head of the user depending on whether the headphones are designed to be worn on-ear or around the ear, respectively. The compressible portion provides both greater comfort and a better seal to inhibit noise from entering the ear canal and inhibit sound from escaping from the headphones. The case for headphones herein may include structure that supports the headphones such that the compressible portions of the earpads are either not touching the tray or are at least not substantially compressed. The tray also preferably includes structure that maintains the headphones in a manner such that the earpads do not touch each other, as is shown in FIG. 1.

Figure 2:
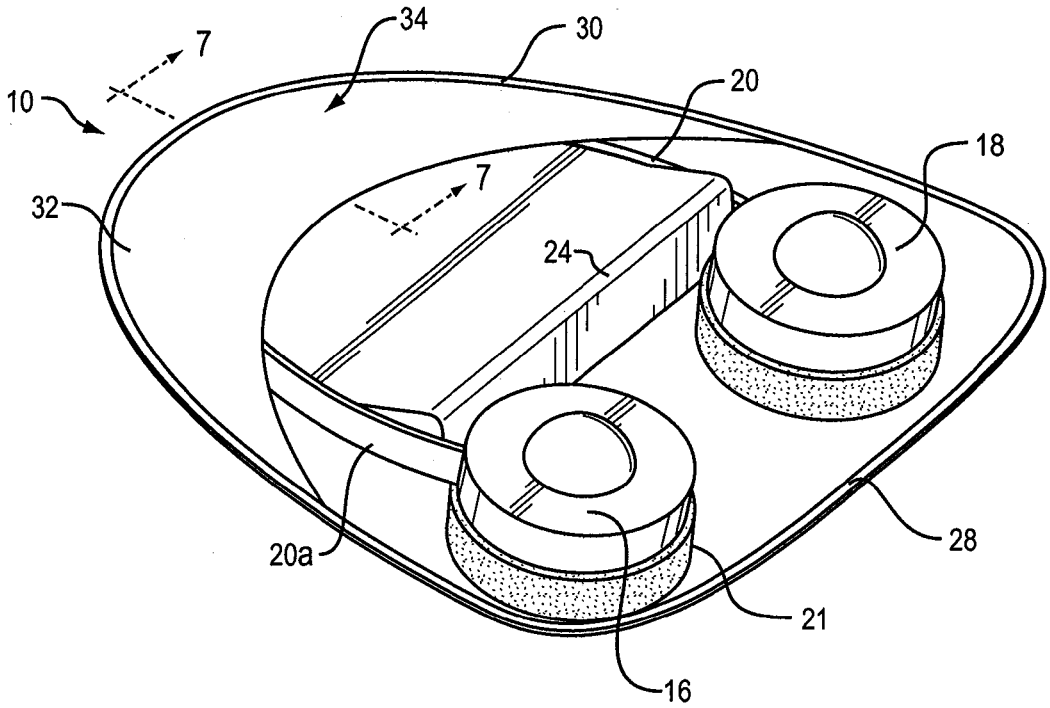
FIG. 2 is a perspective view of a case for headphones in the open position in which the headphones are accessible to the user and ready for retail display.
Figure 3:
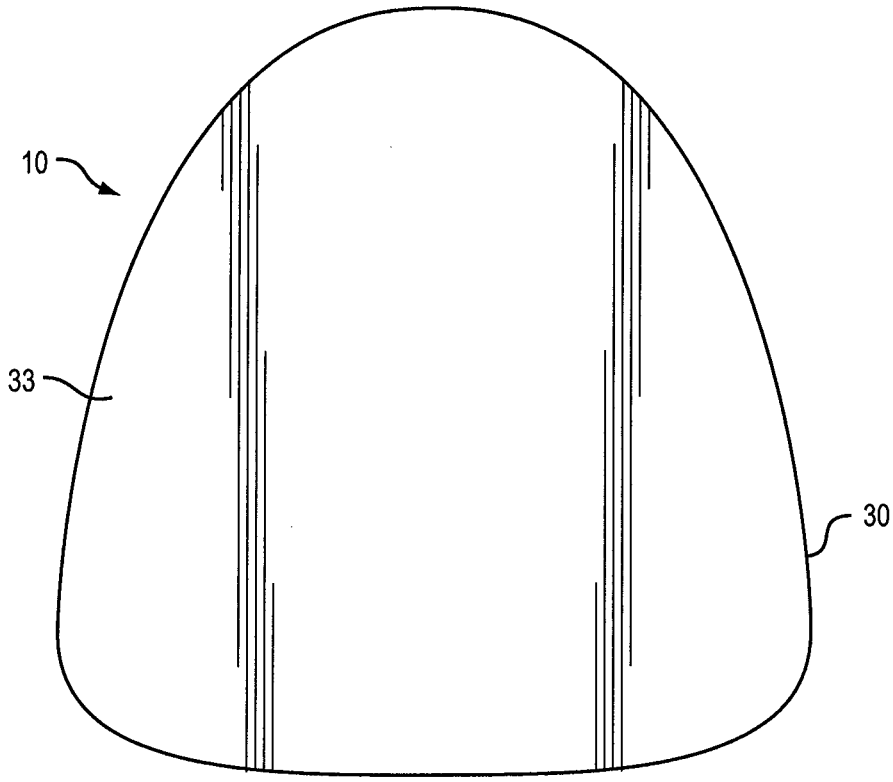
FIG. 3 shows the case for headphones of FIG. 2 in the closed position.
Figure 4:
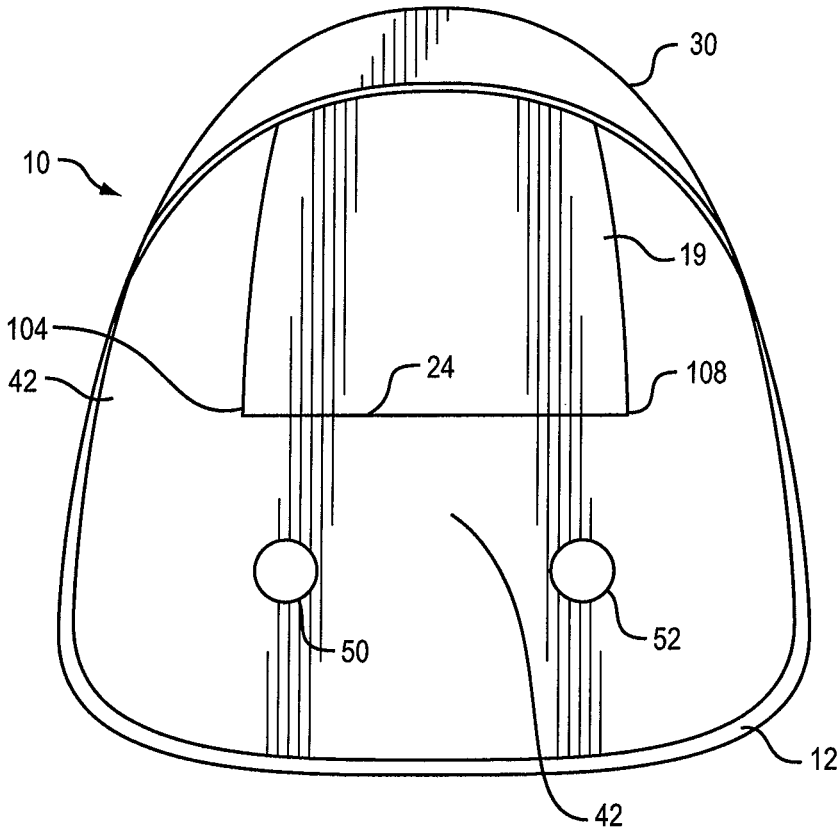
FIG. 4 is a top view of the case for headphones of FIG. 1 without the headphones.
Figure 6:
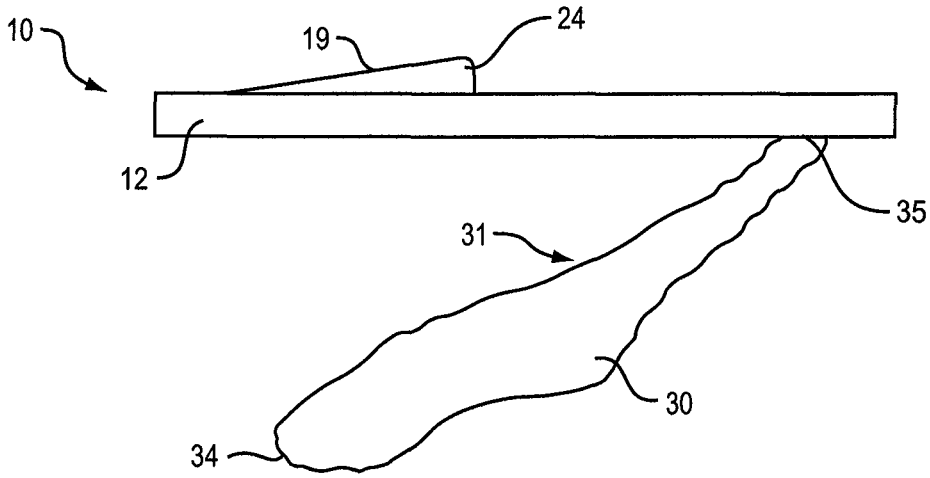
FIG. 6 is a side view of a case for headphones.
Figure 7:
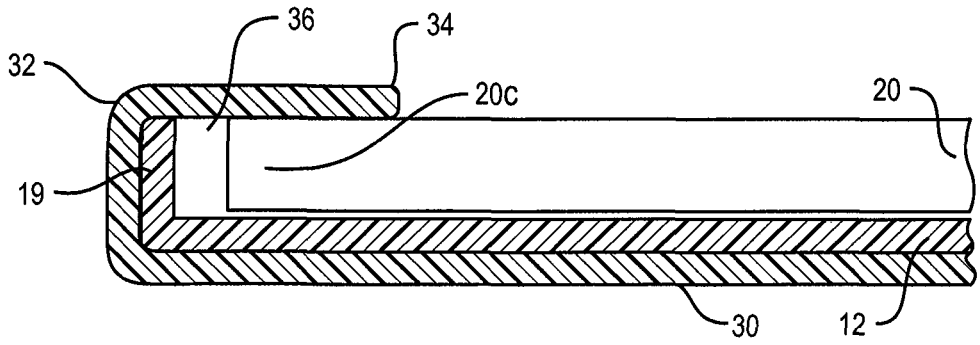
FIG. 7 is a partial enlarged cross-sectional view taken along line 7-7 of FIG. 2.

Case 10 includes resiliently stretchable cover 30 that is fixed to tray 12 and defines a free portion that is adapted to be moved from an open position illustrated in FIGS. 2 and 4 wherein the open front of tray 12 is at least substantially or mostly exposed, to a closed position illustrated in FIG. 3 wherein cover 30 closes the open front of tray 12. In this example, cover 30 is made from a resiliently stretchable material such as Neoprene. The cover is sized, shaped, configured and fixed to the bottom of tray 12 (e.g., at location 35, FIG. 6) in a manner such that it can be stretched over the open front of tray 12 to define a closed position where the outside surface 33 of cover 30 overlies and faces outward from the front of the tray. To open the cover, the distal portion 34 is removed from end 15 of tray 12, folded back, and stretched around the back side of tray 12. This causes the cover to fold inside out. Cover free end 34 is then stretched over narrow end 15 of tray 12 such that end 34 partially overlies the open front of tray 12 to take the position shown in FIGS. 2, 4 and 7 in which cover portion 34 defines the top of pocket 36, the bottom of which is defined by the portion of tray 12 directly underneath cover portion 34. When the pocket is so formed, inside surface 32 of cover 30 overlies the top portion of tray 12 and faces outward from the pocket.

Figure 5:
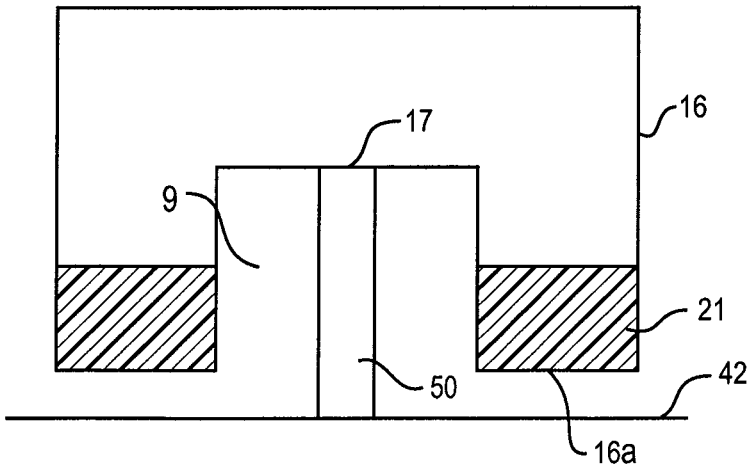
FIG. 5 is a schematic cross-sectional view of a headphone earpad resting on a post of the case for headphones of FIG. 4.

Tray 12 is shown without the headphones in FIG. 4. Tray 12 in this embodiment includes posts 50 and 52 that project upwardly from upper surface 42 of tray 12. Over the ear type headphones, as shown in FIG. 5, include earpad 16 that defines central cavity 9 which is internally delineated by end-wall 17. The headphones are worn such that the ear sits in cavity 9 and surface 16*a* of compressible portion 21 sits against the head of the user. Post 50 is sized, shaped and arranged to fit into cavity 9 and is long enough such that when wall 17 contacts the end of post 50, surface 16*a* does not touch upper surface 42 of tray 12. This prevents the compressible portion 21 of earpad 16 from being compressed while the headphones are stored in the case, which helps to prevent the foam from taking a compressed set or otherwise being degraded while the headphones are stored in the case. Earpad 18 with compressible portion 20 fits over and onto post 52 in the same manner.

Holding the headband in tension also spreads earpads 16 and 18 farther apart than their normal relaxed position; walls 104 and 108 can be sufficiently spaced such that when headband 20 is held against the outside of plateau 19, earpads 16 and 18 do not touch. This helps to prevent scratching and other physical damage that can occur to the earpads as the case is moved around while the headphones are stored in the case.

Tray 12 has a thickness that is approximately about as great as or just greater than the width of headband 20, and thus is only about half as thick as a typical two-piece hinged clamshell case. Pocket 36 preferably has a depth that is slightly less than the width of headband 20. Since cover 30 is resilient, when headband 20 is slipped into pocket 36 such that distal end 20*c* lies against end wall 29 of plateau 19, cover portion 34 is slightly stretched by the headband and thus the cover places a downward force on the headband. This force helps to maintain the headband in place and prevent it from moving substantially as the case is moved and jostled, such that the headphones are retained in the case even when the cover is in the open position.

Figure 8:
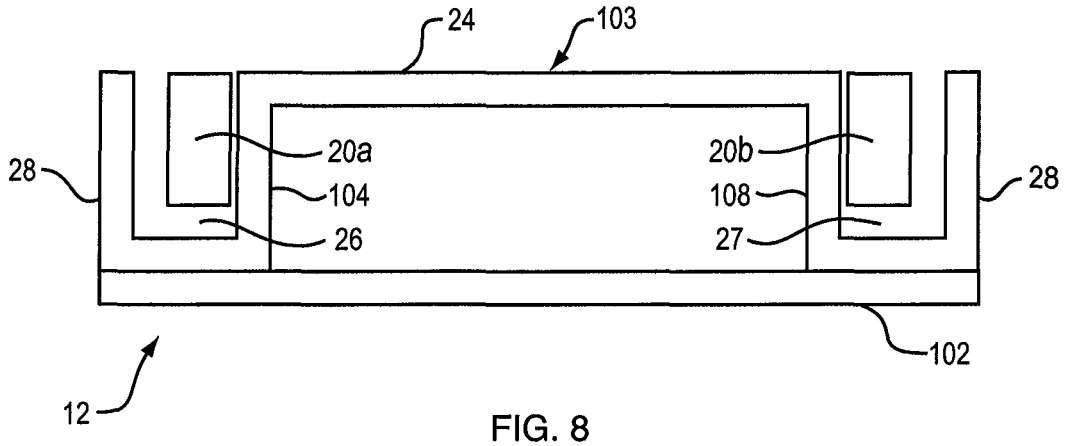
FIG. 8 is a cross-sectional view showing a headphone headband engaged with a case for headphones.

Tray 12 can be constructed as one piece, or multiple pieces fixed together such as by an adhesive. In the embodiment shown in FIG. 8, tray 12 is made from two molded pieces of thin EVA that are glued together. Flat lower piece 102 is glued to separate upper piece 103 that has a raised area that defines plateau 19 with walls 24, 104 and 108. Plateau 19 is spaced from rim 28 to define channels 26 and 27 that receive headband portions 20*a* and 20*b*, respectively. Plateau 19 also defines distal wall 29.

Figure 9A:
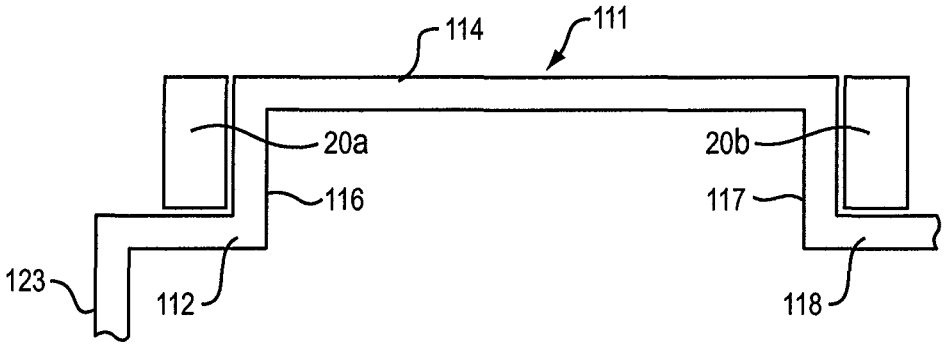
FIG. 9A is a partial schematic cross-sectional view of a headphone headband engaged with a different case for headphones.
Figure 9B:
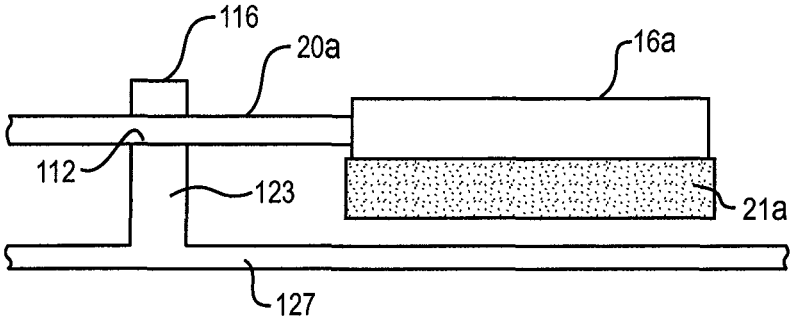
FIG. 9B is a partial schematic cross-sectional view of a headband and earpad of headphones engaged with the case for headphones shown in FIG. 9A.

One of myriad possible alternative tray constructions is shown in FIGS. 9A and 9B, wherein tray 111 defines plateau 114 with sidewalls 116 and 117 that maintain headband portions 20*a* and 20*b* in tension, in the manner described above. Tray 111 further defines shelves 112 and 118 on which headband portions 20*a* and 20*b* can rest. Raised portion 123 that projects from floor 127 of tray 111 is sufficiently high such that earpad 16 is held off of floor 127 such that compressible portion 21*a* does not touch the tray.

Figure 10A:
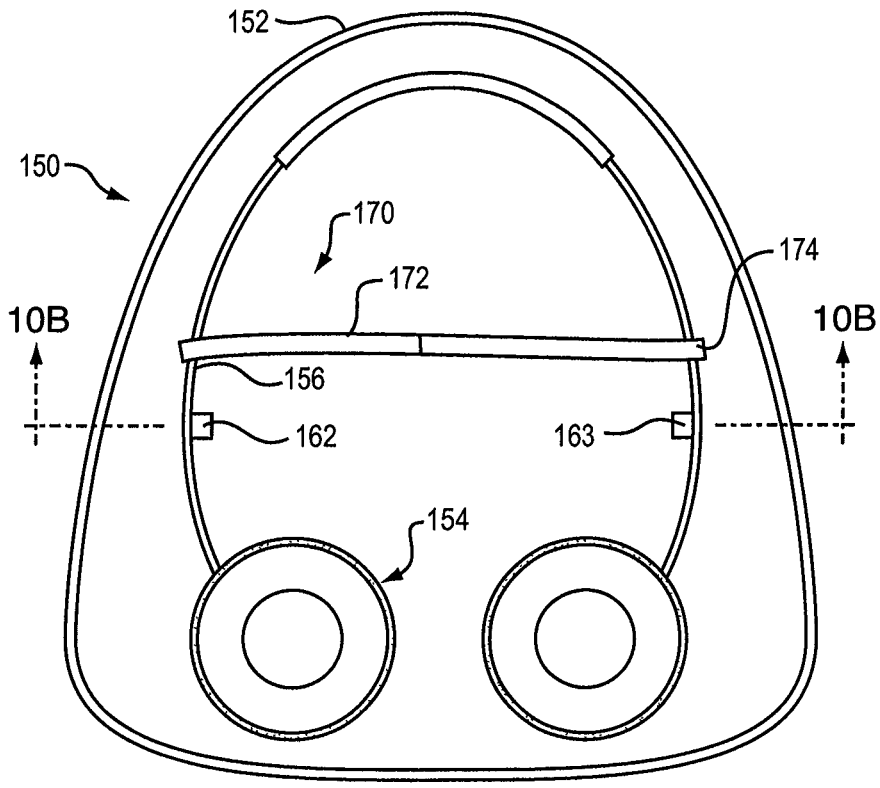
FIG. 10A is a top view of a case for headphones.
Figure 10B:
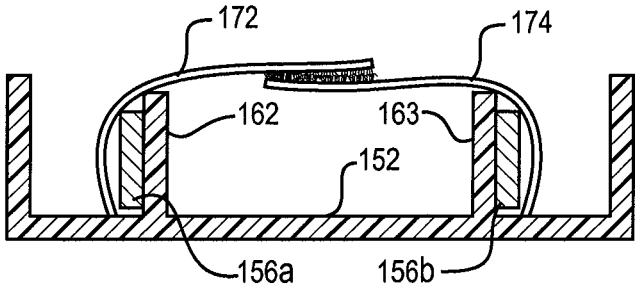
FIG. 10B is a cross-sectional view of the case for headphones of FIG. 10A.

Headphone case 150, FIGS. 10A and 10B, illustrates alternative means of holding the headband in tension, restraining the headband, and spacing the earpads from each other. Tray 152 defines posts or raised areas 162 and 163 that are the structure that maintains the headband in tension and such that the earpads do not touch, as shown by headband portions 156*a* and 156*b* lying against posts 162 and 163, respectively. Headband 156 is restrained by two-part separable strap 170 comprising portions 172 and 174 that can be releasably coupled together, for example using a hook and loop-type fastener, or a snap or buckle or other mechanical fastening system.

Figure 11:
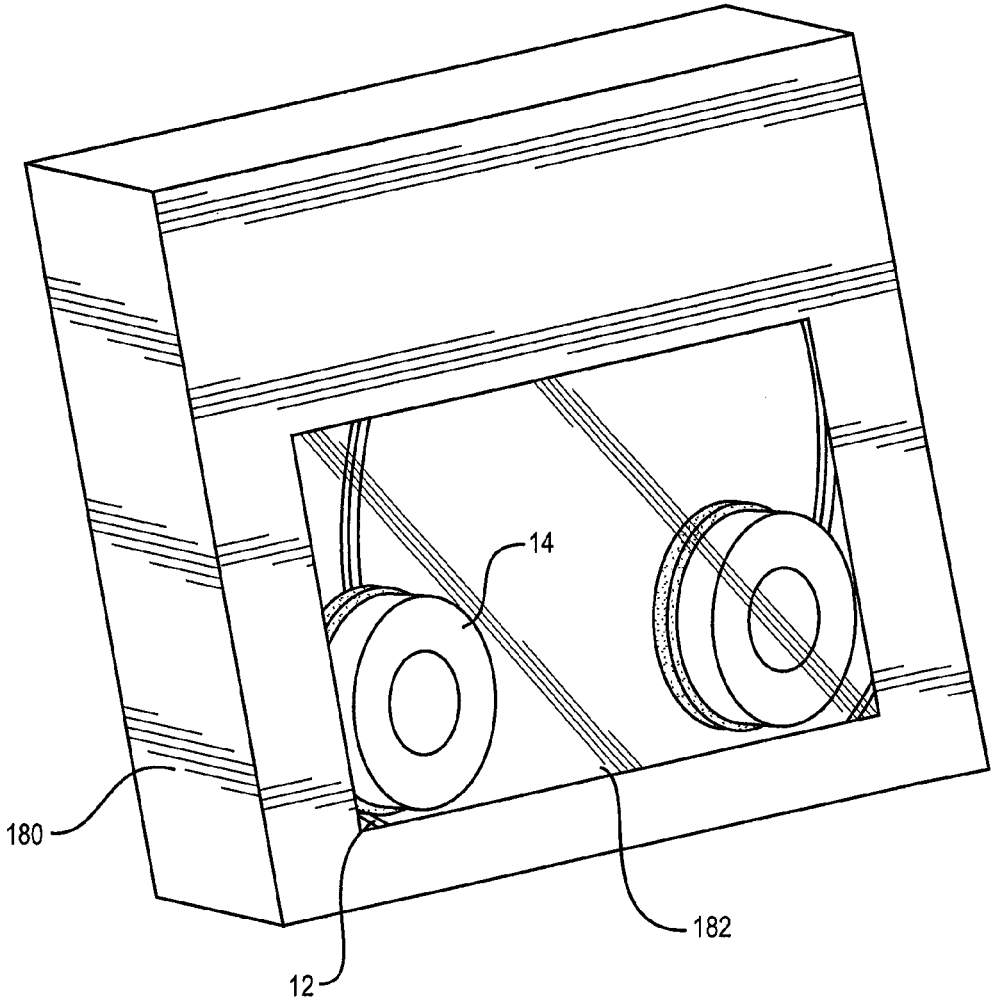
FIG. 11 is a perspective view of the case for headphones of FIG. 1 in a retail display box.

The resiliently stretchable cover only covers a portion of the open front of the tray in the open position. Even though the headphones are maintained securely within the case in the open position, the earpads are thus visible from the front of the tray. This allows the case to also be used to package the headphones for retail display, for example in the manner shown in FIG. 11 in which case 10 is received in a cardboard box 180 having clear panel or window 182 through which headphones 14 can be viewed.

A number of embodiments and options have been described herein. Modifications may be made without departing from the spirit and scope of the invention. For example, the embodiments illustrate a raised plateau that angles downward toward the floor of the tray from the high point of the ledge that is close to the middle of the tray to the low point at the distal end. The plateau need not be flat, and does not need to be angled, or could angle in other ways. Also, the function of defining a position for the headband in which it is held in tension and held in position relative to the tray can be accomplished in other manners. For example, rather than a plateau or other unitary raised feature that defines the necessary headband restraining walls, separate projections against which the headband would rest could be used. Or, headband-receiving slots could be molded into the tray at two or more locations that defined a desired headband location. Particularly since thin molded plastic has some flexibility or give to it, receiving slots defined by walls that are slightly closer together than the thickness of the headband would accomplish a headband interference fit that would also help hold the headband down on the tray.

Accordingly, other embodiments are within the claims.

What is claimed is:

1. A case for headphones that comprise two earpads connected by a flexible headband, wherein the earpads have a compressible portion that is adapted to sit on the ear or head, the case for headphones comprising:

a tray defining an open front that is adapted to receive the headphones, wherein the tray comprises structure that maintains the headband in tension; and a resiliently stretchable cover fixed to the tray and defining a free portion adapted to be moved from a closed position wherein the cover closes the open front of the tray to an open position wherein the open front of the tray is at least substantially exposed;

wherein in the open position the cover and the tray together define a pocket that receives the headband such that a downward force is present on the headband;

wherein the tray defines a wider end where the earpads are located and a narrower end where a portion of the headband is located, and wherein the pocket is located at the narrower end of the tray; and wherein the free portion of the cover defines an outside and an inside and wherein in the closed position the outside of the free portion of the cover overlies and faces outward from the front of the tray and wherein in the open position the inside of the free portion of the cover faces outward from the pocket.

2. The headphone case of claim 1 wherein the headphones are received by the tray such that the earpads do not touch each other.

3. The headphone case of claim 1 further comprising a strap fixed to the tray and that defines a first position in which it lies across and restrains the headband and a second position in which it is free from and does not restrain the headband.

4. A case for headphones that comprise two earpads connected by a flexible headband, wherein the earpads have a compressible portion that is adapted to sit on the ear or head, the case for headphones comprising:

a tray defining an open front that is adapted to receive the headphones such that the earpads do not touch each other, wherein the tray defines a plateau spaced from the edges of the tray and that defines a raised wall that spans most of the width of the tray, that is substantially the same height as the width of the headband and that defines sidewalls against which the headband sits so as to maintain the headband in tension;

wherein the tray further comprises upwardly-projecting posts located in the earpads and that support the earpads such that the compressible portions are spaced above the tray surface;

a resiliently stretchable cover fixed to the tray and defining a free portion adapted to be moved from a closed position wherein the cover closes the open front of the tray to an open position wherein the open front of the tray is at least substantially exposed, wherein in the open position the cover and the tray together define a pocket that receives the headband such that a downward force is present on the headband;

wherein the tray defines a wider end where the earpads are located and a narrower end where a portion of the headband is located, and wherein the pocket is located at the narrower end of the tray; and wherein the free portion of the cover defines an outside and an inside and wherein in the closed position the outside of the free portion of the cover overlies and faces outward from the front of the tray and wherein in the open position the inside of the free portion of the cover faces outward from the pocket.

5. A case for headphones that comprise two earpads connected by a flexible headband, wherein the earpads have a compressible portion that is adapted to sit on the ear or head, the case for headphones comprising:

a tray defining an open front that is adapted to receive the headphones, wherein the tray comprises structure that maintains the headband in tension, and wherein the tray further defines posts projecting upwardly from the tray, wherein the earpads sit on the posts to support the headphones such that the compressible portions of the earpads are not substantially compressed; and a resiliently stretchable cover fixed to the tray and defining a free portion adapted to be moved from a closed position wherein the cover closes the open front of the tray to an open position wherein the open front of the tray is at least substantially exposed.

6. The headphone case of claim 5 wherein the posts are located in the earpads.

7. A case for headphones that comprise two earpads connected by a flexible headband, wherein the earpads have a compressible portion that is adapted to sit on the ear or head, the case for headphones comprising:

a tray defining an open front that is adapted to receive the headphones, wherein the tray comprises structure that maintains the headband in tension, wherein the structure that maintains the headband in tension comprises projections against which the headband sits, wherein the projections are defined proximate two opposed edges of the tray and wherein the projections are defined by walls of a raised plateau that spans most of the width of the tray; and a resiliently stretchable cover fixed to the tray and defining a free portion adapted to be moved from a closed position wherein the cover closes the open front of the tray to an open position wherein the open front of the tray is at least substantially exposed.

8. The headphone case of claim 7 wherein the plateau is spaced from the edge of the tray.

9. The headphone case of claim 7 wherein the projections are about at least as high as the width of the headband at the locations where the headband sits against the projections.

10. The headphone case of claim 9 wherein the projections are substantially the same height as the width of the headband at the locations where the headband sits against the projections.

* * * * *